US007001259B1

(12) United States Patent
Wu

(10) Patent No.: US 7,001,259 B1
(45) Date of Patent: Feb. 21, 2006

(54) BLADE GRINDER FOR GARDENING CUTTING TOOL

(75) Inventor: Shih-Piao Wu, Lu Kang (TW)

(73) Assignee: Jiin Haur Industrial Co., Ltd., Ku Kang (TW)

( * ) Notice: Subject to any disclaimer, the term of this patent is extended or adjusted under 35 U.S.C. 154(b) by 0 days.

(21) Appl. No.: 10/963,451

(22) Filed: Oct. 13, 2004

(51) Int. Cl.
*B24B 9/00* (2006.01)

(52) U.S. Cl. ..... 451/349; 76/82.2

(58) Field of Classification Search ..... 451/45, 451/344, 349, 523, 524, 557; 76/81, 82, 76/82.2
See application file for complete search history.

(56) References Cited

U.S. PATENT DOCUMENTS 932,586 A * 8/1909 Sheffield ..... 76/82.2
4,348,809 A * 9/1982 Jackson ..... 30/138
5,001,945 A * 3/1991 Lindeen ..... 76/82.2
5,251,351 A * 10/1993 Klotz ..... 7/100
5,291,805 A * 3/1994 Byers et al. ..... 76/88
5,472,375 A * 12/1995 Pugh ..... 451/367
6,119,554 A * 9/2000 Plankenhorn ..... 76/82

* cited by examiner

*Primary Examiner*—Jacob K. Ackun, Jr.
(74) *Attorney, Agent, or Firm*—Alan D. Kamrath; Nikolai & Mersereau, P.A.

(57) ABSTRACT

A blade grinder includes a main body having a first end formed with a blade seat, an oil impregnated member mounted on a second end of the main body, and a grinding member mounted on the blade seat. Thus, one of the blades of the gardening cutting tool is rested on the grinding member and held by a user's one hand, so that the included angle between the blade of the gardening cutting tool and the grinding member can be adjusted to control the grinding angle the blade relative to the grinding member, thereby facilitating the user grinding the blade, and thereby enhancing the grinding effect of the grinding member.

5 Claims, 3 Drawing Sheets

BLADE GRINDER FOR GARDENING CUTTING TOOL

BACKGROUND OF THE INVENTION

1. Field of the Invention

The present invention relates to a blade grinder, and more particularly to a blade grinder for a gardening cutting tool.

2. Description of the Related Art

A conventional grindstone for a gardening cutting tool is used to grind and finish the blade of the gardening cutting tool when the blade is worn or rusted. However, the grinding angle between the blade of the gardening cutting tool and the grindstone cannot be controlled easily, thereby causing inconvenience to a user when grinding the blade of the gardening cutting tool, and thereby decreasing the grinding effect of the grindstone.

SUMMARY OF THE INVENTION

In accordance with the present invention, there is provided a blade grinder, comprising: a main body having a first end formed with a blade seat; an oil impregnated member mounted on a second end of the main body; and a grinding member mounted on the blade seat of the main body.

The primary objective of the present invention is to provide a blade grinder for grinding and finishing blades of a gardening cutting tool.

Another objective of the present invention is to provide a blade grinder, wherein one of the blades of the gardening cutting tool is rested on the grinding member of the blade grinder and held by a user's one hand, so that the included angle between the blade of the gardening cutting tool and the grinding member of the blade grinder can be adjusted so as to control the grinding angle the blade of the gardening cutting tool relative to the grinding member of the blade grinder, thereby facilitating the user grinding the blade of the gardening cutting tool, and thereby enhancing the grinding effect of the grinding member of the blade grinder.

A further objective of the present invention is to provide a blade grinder, wherein the oil cloth is removed from the main body 1 by rotation of the oil impregnated member to wipe and lubricate the finished blade of the gardening cutting tool, thereby facilitating maintenance of the blade of the gardening cutting tool.

Further benefits and advantages of the present invention will become apparent after a careful reading of the detailed description with appropriate reference to the accompanying drawings.

DETAILED DESCRIPTION OF THE INVENTION

Figure 1:
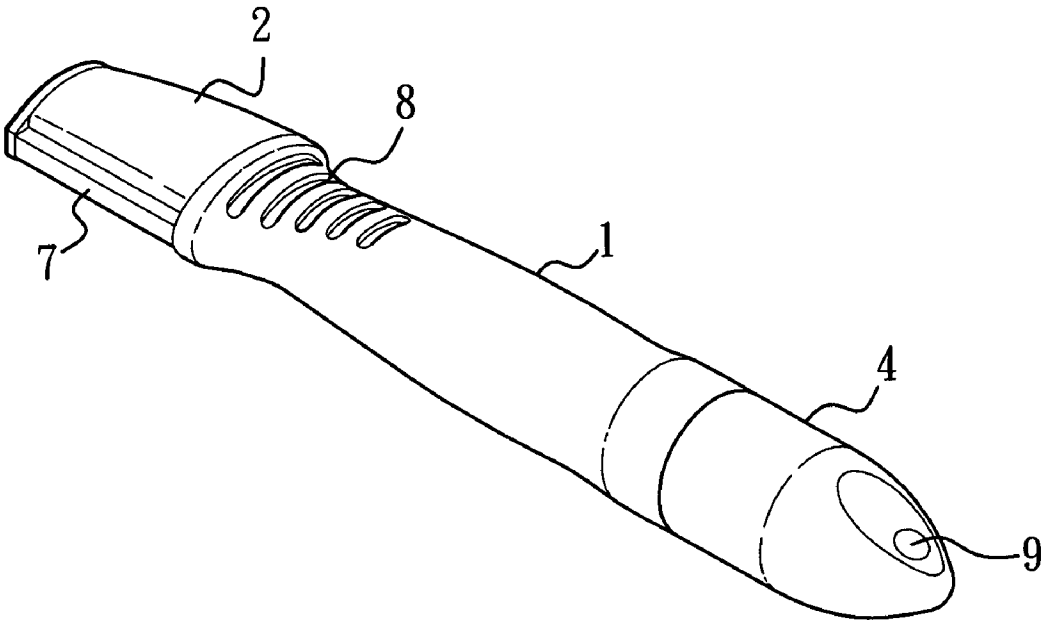
FIG. 1 is a perspective view of a blade grinder in accordance with the preferred embodiment of the present invention.
Figure 2:
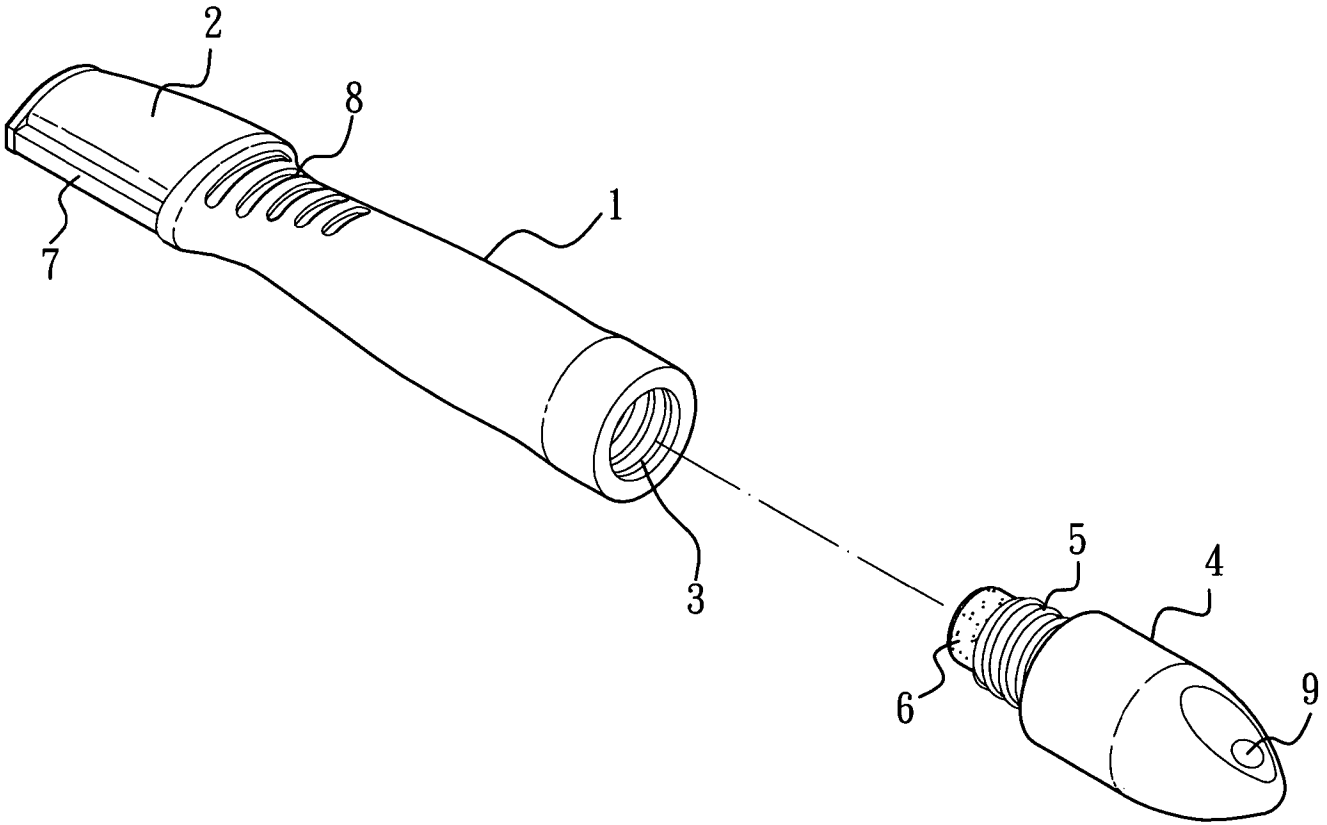
FIG. 2 is an exploded perspective view of the blade grinder as shown in FIG. 1.

Referring to the drawings and initially to FIGS. 1 and 2, a blade grinder for a gardening cutting tool in accordance with the preferred embodiment of the present invention comprises a main body 1 having a first end formed with a blade seat 2, an oil impregnated member 4 mounted on a second end of the main body 1, and a grinding member 7 mounted on the blade seat 2 of the main body 1.

The main body 1 has a handle shape. The main body 1 has a periphery formed with a plurality of elongated anti-skid grooves 8 having different length. The second end of the main body 1 has an inside formed with a screw bore 3.

The oil impregnated member 4 has a first end formed with an outer thread 5 screwed into the screw bore 3 of the main body 1, so that the oil impregnated member 4 is detachably mounted on the main body 1. The first end of the oil impregnated member 4 has an end face provided with an oil cloth 6 located beside the outer thread 5 and received in the inside of the main body 1. The oil impregnated member 4 has a second end formed with a hanging hole 9.

Figure 3:
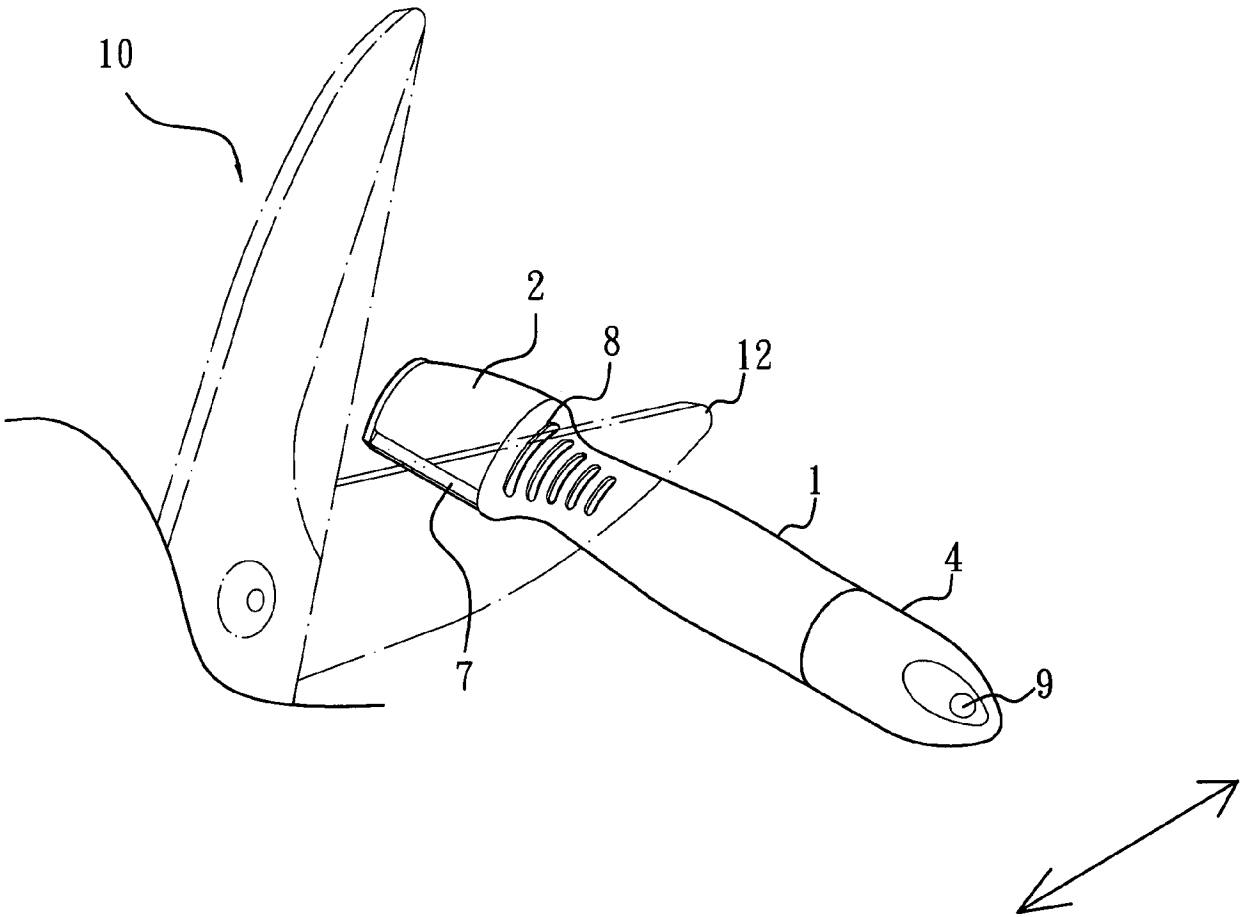
FIG. 3 is a schematic operational view of the blade grinder as shown in FIG. 1 in use.

As shown in FIG. 3, the blade grinder is used for a gardening cutting tool 10, such as a pair of pruning shears or clippers. At this time, one of the blades 12 of the gardening cutting tool 10 is rested on the grinding member 7 of the blade grinder and held by a user's one hand, so that the included angle between the blade 12 of the gardening cutting tool 10 and the grinding member 7 of the blade grinder can be adjusted so as to control the grinding angle the blade 12 of the gardening cutting tool 10 relative to the grinding member 7 of the blade grinder, thereby facilitating the user grinding the blade 12 of the gardening cutting tool 10, and thereby enhancing the grinding effect of the grinding member 7 of the blade grinder. In addition, the oil cloth 6 is removed from the main body 1 by rotation of the oil impregnated member 4 to wipe and lubricate the finished blade 12 of the gardening cutting tool 10, thereby facilitating maintenance of the blade 12 of the gardening cutting tool 10.

Accordingly, one of the blades of the gardening cutting tool is rested on the grinding member of the blade grinder and held by a user's one hand, so that the included angle between the blade of the gardening cutting tool and the grinding member of the blade grinder can be adjusted so as to control the grinding angle the blade of the gardening cutting tool relative to the grinding member of the blade grinder, thereby facilitating the user grinding the blade of the gardening cutting tool, and thereby enhancing the grinding effect of the grinding member of the blade grinder. In addition, the oil cloth is removed from the main body 1 by rotation of the oil impregnated member to wipe and lubricate the finished blade of the gardening cutting tool, thereby facilitating maintenance of the blade of the gardening cutting tool.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A blade grinder, comprising:

a main body having a first end formed with a blade seat;

an oil impregnated member mounted on a second end of the main body; and a grinding member mounted on the blade seat of the main body; wherein the second end of the main body has an inside formed with a screw bore, and the oil impregnated member has a first end formed with an outer thread screwed into the screw bore of the main body, so that the oil impregnated member is detachably mounted on the main body;

the first end of the oil impregnated member has an end face provided with an oil cloth located beside the outer thread and received in the inside of the main body.

2. The blade grinder in accordance with claim 1, wherein the main body has a handle shape.

3. The blade grinder in accordance with claim 1, wherein the main body has a periphery formed with a plurality of elongated anti-skid grooves having different length.

4. The blade grinder in accordance with claim 1, wherein the oil cloth is removed from the main body by rotation of the oil impregnated member.

5. A blade grinder, comprising:

a main body having a first end formed with a blade seat;

an oil impregnated member mounted on a second end of the main body; and a grinding member mounted on the blade seat of the main body; wherein the second end of the main body has an inside formed with a screw bore, and the oil impregnated member has a first end formed with an outer thread screwed into the screw bore of the main body, so that the oil impregnated member is detachably mounted on the main body, wherein the oil impregnated member has a second end formed with a hanging hole.

* * * * *